United States Patent [19]

Price

[11] Patent Number: 4,987,809

[45] Date of Patent: Jan. 29, 1991

[54] PRODUCTION OF SMALL-SIZED PRINTED PRODUCTS

[75] Inventor: Frederick F. Price, Chicago, Ill.

[73] Assignee: The Wessel Company, Inc., Elk Grove Village, Ill.

[21] Appl. No.: 512,542

[22] Filed: Apr. 18, 1990

Related U.S. Application Data

[63] Continuation of Ser. No. 328,329, Mar. 24, 1989, abandoned.

[51] Int. Cl.[5] ..... B26H 35/04

[52] U.S. Cl. ..... 83/27; 83/88; 83/94; 83/155; 83/156

[58] Field of Search ..... 83/86, 88, 94, 422, 83/436, 155, 156, 404, 84, 85, 27, 29; 271/272, 69, 198; 198/604, 605

[56] References Cited

U.S. PATENT DOCUMENTS

| | | | |
|---|---|---|---|
| 2,261,972 | 11/1941 | Matthews | 83/88 X |
| 2,467,423 | 4/1949 | Bruker | 271/69 |
| 3,336,028 | 8/1967 | Schonmeier | 83/88 |
| 3,545,371 | 12/1970 | Reist | 271/272 X |
| 3,550,493 | 12/1970 | Benbenek | 83/94 X |
| 4,148,475 | 4/1979 | Schulz | 271/294 |
| 4,216,952 | 8/1980 | McInerny | 271/122 X |
| 4,640,506 | 2/1987 | Luperti et al. | 271/245 X |
| 4,727,784 | 3/1988 | Sarka et al. | 83/88 X |

FOREIGN PATENT DOCUMENTS

| | | | |
|---|---|---|---|
| 1112446 | 3/1946 | France | 83/88 |

*Primary Examiner*—Frank T. Yost
*Assistant Examiner*—Rinaldi Rada
*Attorney, Agent, or Firm*—Marshall, O'Toole, Gerstein, Murray & Bicknell

[57] ABSTRACT

Small-sized, folded, glued coupons for insertion into a food package are made on a continuous line starting with a roll of paper and finishing with a straight, aligned, moving row of finished coupons, disposed in shingled relation to facilitate arranging in a row in a tray for immediate packing in a container for shipment to a user, without manual handling prior to arranging in the tray. The line includes equipment for (1) receiving individual coupons from a rotary cutter in a straight-line alignment in a downstream direction, (2) maintaining that alignment and (3) delivering the coupons in that alignment to a conveyor in such a manner as to facilitate arrangement in the desired shingled relation. Cleanliness is maximized and pilferage is minimized.

23 Claims, 3 Drawing Sheets

PRODUCTION OF SMALL-SIZED PRINTED PRODUCTS

This application is a continuation of application Ser. No. 07/328,329, filed Mar. 24, 1989 now abandoned.

BACKGROUND OF THE INVENTION

The present invention relates generally to the production of printed products and more particularly to the production of small-sized, printed products which require folding, gluing and stacking, such as small-sized coupons intended for inclusion in food packages, for example.

Printed products are conventionally produced on a continuous line which starts with a roll of paper at an upstream end and dispenses individual pieces of printed product at a downstream end. Mechanical steps, such as slitting the roll into ribbons, folding a ribbon, applying glue to a ribbon, and transversely cutting a ribbon into individual pieces are conventionally performed on the continuous line.

It is oftentimes desirable to deliver the individual pieces of printed product, at the downstream end of a continuous line, as a row of pieces in straight, aligned, shingled relation. This facilitates handling and packaging of the pieces of printed product for delivery to a user. Printed products having a relatively large dimension in a downstream direction (i.e., from leading edge to trailing edge of the printed product), e.g., about 5¼ in. (13.3 cm) or more, can be manufactured and delivered in this manner with conventional equipment.

Such conventional equipment includes a rotary cutter which receives a continuous ribbon containing a multiplicity of connected printed products, usually folded and glued. The rotary cutter cuts the ribbon transversely into a series of individual pieces of printed product. Located immediately downstream of the rotary cutter are a series of driven rollers which receive each individual piece of the printed product from the rotary cutter and deliver it to a conveyor located immediately downstream of the driven rollers. Located above the driven rollers are a plurality of idler wheels which are urged downwardly to engage the top surface of the printed product as it is moved downstream by the driven rollers.

The conveyor located downstream of the driven rollers is operated at a slower speed than the driven rollers so that, as the individual pieces of printed product are delivered from the driven rollers onto the conveyor, they are automatically arranged in shingled relation, in a row. In order for printed products to be effectively arranged in shingled relation on the conveyor, the printed products must not undergo deflection between the time they leave the rotary cutter and the time they arrive at the conveyor. Deflection occurs when the leading or downstream edge of a printed product moves above or below a plane defined by the tops of the driven rollers, or when the printed product is angled to one side of a straight line extending in a downstream direction along the rollers.

With relatively large-sized printed products, such as those described three paragraphs above, deflection is not a problem when employing the conventional equipment described in the preceding two paragraphs. However, with relatively small-sized printed products, such as coupons which are to be included within a food package, that equipment cannot deliver the individual pieces of small-sized, printed product to the conveyor consistently without deflection. A typical example of such a small-sized printed product is one having dimensions of about 2-3/16 in. (5.6 cm) from leading edge to trailing edge and about 2 in. (5.1 cm) transverse thereto. The user or customer inserts these individual coupons into food packages such as cereal boxes or snack packages.

There have been two conventional procedures for handling the small-sized printed products described in the preceding paragraph. One procedure has been to dispense the individual pieces of folded, glued, printed product from the rotary cutter directly into a large-sized container, without any attempt at orderly arrangement. This is known as so-called "fluff" packaging, but this procedure cannot be employed when the user requires that the product be delivered in an orderly arrangement.

Another procedure is laborious and involves a very substantial amount of manual handling. In this other procedure, folding, gluing and transverse cutting operations are not performed on the continuous line. Instead, large sheets, each containing a multitude of connected pieces (e.g., 32 pieces) of unfolded, unglued, printed product are produced on the continuous line. These large sheets are then transferred to a first processing apparatus which cuts each large sheet into a large number of smaller parts, e.g., 16 parts, each containing 2 pieces of printed product connected together. Each of these parts is then transferred to a second processing apparatus which applies a spot of glue to each of the 2 pieces on a part, folds each part (e.g., 2 folds to fold the part into thirds), and then cuts each part into 2 individual pieces. The individual pieces, which have been glued, folded and cut when they emerge from the second apparatus, also emerge arranged in an orderly fashion to permit packaging in rows in a container for shipment to a user.

Before each of the two transferring steps described in the preceding paragraph, the incompletely processed printed products are manually loaded on pallets. At each of the two processing apparatuses, the incompletely processed printed products are manually removed from the pallets and manually introduced into the respective apparatus for processing.

When coupons are to be included in food packages, it is desirable, from a sanitary standpoint, to minimize the amount of manual handling to which these coupons are subjected during the manufacturing process. The above-described batch procedure for producing an orderly arrangement of such coupons employs a relatively large number of manually handling steps, and that is undesirable.

Coupons have a monetary value. Unless strict security is maintained, theft can be a problem. When a number of individual processing operations are employed at separate processing stations, as in the batch procedure described above, a backlog of partially processed coupons can accumulate at each of the individual stations, awaiting processing; and this exacerbates the theft problems. Typically, there are stacks of uncompleted coupons, in various stages of processing, sitting on pallets at each of the processing stations.

Another drawback to the conventional, multi-operation, batch procedure described above is the relatively limited production rate available therewith, e.g., 500,000–600,000 pieces in a 24-hour period.

SUMMARY OF THE INVENTION

An apparatus in accordance with the present invention produces small-sized, printed coupons which have been printed, folded, glued, cut and arranged in a row in shingled relation, in a continuous uninterrupted operation starting with a roll of paper, and the individual pieces are untouched by human hands.

The apparatus employs a continuous belt defining a continuous, uninterrupted bridge between the rotary cutter and the conveyor located downstream of the rotary cutter. The bridge has an upstream end adjacent the rotary cutter and a downstream end adjacent the conveyor. The upstream end is positioned sufficiently close to the rotary cutter to receive a small-sized coupon discharged from the rotary cutter, before the coupon has an opportunity to deflect upwards or downwards or sideways from the straight-line alignment in which it is initially discharged from the rotary cutter.

The continuous belt is driven to carry the coupons in a downstream direction toward the conveyor. Positioned above the belt is a first coupon-engaging structure which cooperates with the belt to maintain the speed of movement of the small-sized coupon, in a downstream direction, the same as the speed of the belt. The coupon is engaged from above by this structure immediately upon being received by the belt, to prevent the downstream or leading edge of the coupon from deflecting upward.

Located downstream of the first coupon-engaging structure is a second coupon-engaging structure, also positioned above the belt, for maintaining the coupon in straight-line alignment as the coupon undergoes transference from the belt to the conveyor. In addition, the second coupon-engaging structure cooperates with the belt to restrain the small-sized coupon from shooting off the downstream end of the bridge toward the conveyor.

The coupon is maintained in the desired straight-line alignment from the upstream end of the bridge to the downstream end thereof. The coupon does not undergo deflection either vertically or sideways at any time from the time it leaves the rotary cutter until the time it is received on the conveyor.

Coupons received on the conveyor, after having been processed by the equipment described above, are arranged in straight, aligned, shingled relation and are conveyed further downstream by the conveyor in that arrangement. As a row of shingled coupons proceeds down the conveyor, a group thereof can be readily picked off by a worker and arranged in a row on a tray packed in a container for shipment to a user. The worker wears gloves, a hat and other clean-room gear. This is the only handling to which the coupons are subjected before they are received by the user. Only one set of hands touches the product during the entirety of the operation beginning with the roll of paper. Cleanliness is maintained.

Because the operation is continuous, without interruption, from the roll of paper to the shingled row of finished coupons, and because the shingled coupons are packaged immediately, there are no coupons left sitting around in various intermediate stages of processing. Therefore, theft problems are minimized.

The rate of production is increased by more than an order of magnitude, compared to conventional practice in which the coupons were cut, folded and glued in batch operations following printing.

In one embodiment, the apparatus may be readily converted back and forth between two capabilities, one for producing small-sized coupons for food packages, and another for producing larger-sized printed products, thereby providing an apparatus with increased versatility.

Other features and advantages are inherent in the structure claimed and disclosed or will become apparent to those skilled in the art from the following detailed description in conjunction with the accompanying diagrammatic drawings.

DETAILED DESCRIPTION

Figure 1:
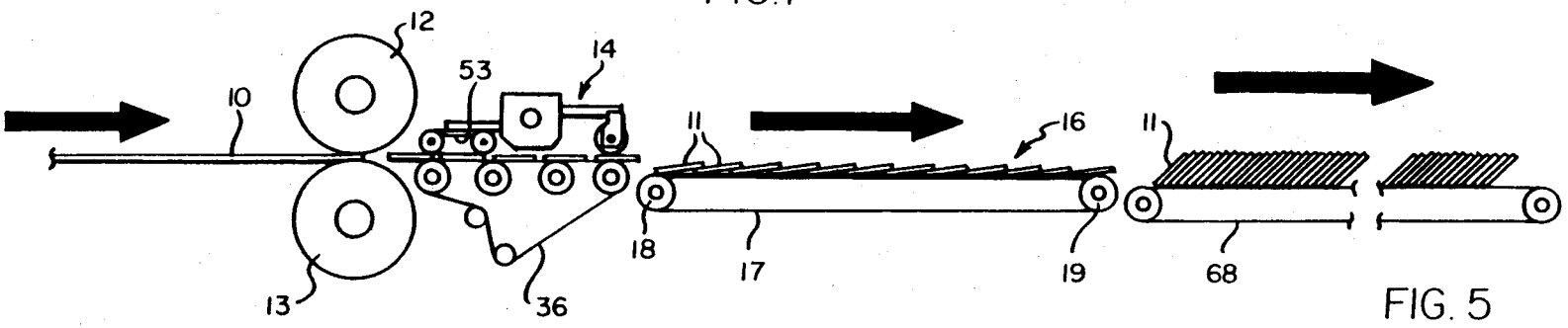
FIG. 1 is a schematic diagram of an apparatus constructed in accordance with an embodiment of the present invention.
Figure 2:
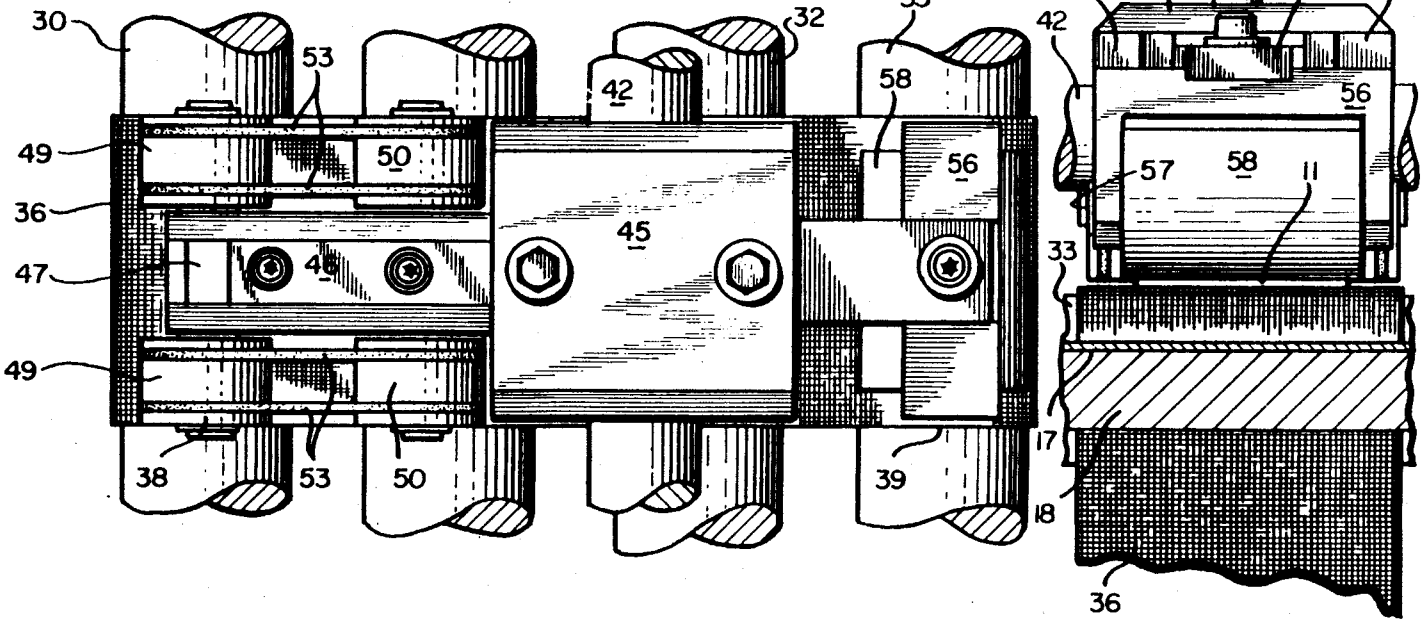
FIG. 2 is an enlarged plan view of a portion of the apparatus.

Referring initially to FIG. 1, indicated at 10 is a continuous, longitudinal ribbon of connected pieces of a printed product such as a coupon for inserting in a food package. Ribbon 10 is moving in a downstream direction indicated by the arrows in FIG. 1. Typically, the ribbon has been folded into thirds, and a spot of glue has been applied between a pair of adjacent folded panels, at spaced locations along the ribbon, to prevent the pieces from unfolding after they have been separated. The ribbon is transversely cut by a rotary cutter 12 cooperating with an anvil 13 to separate ribbon 10 into a multiplicity of individual pieces of printed product, indicated at 11,11. For convenience purpose, the pieces of printed product will hereinafter be referred to as coupons 11.

The individual coupons 11 are discharged from rotary cutter 12/anvil 13 in a straight-line alignment in the downstream direction and are received by a piece of equipment, indicated generally at 14, for maintaining the coupons in that straight-line alignment and for delivering the coupons in that alignment, undeflected, to a shingling conveyor indicated generally at 16 and comprising a continuous belt 17 extending around a plurality of roller 18,19, at least one of which is driven. Conveyor 16 moves in a downstream direction at a slower speed than do coupons 11 as they are delivered by equipment 14 onto conveyor 16, and the net result is that coupons 11 become shingled on conveyor 16 which delivers the coupons in a straight, aligned row, in shingled relation, in a downstream direction.

Figure 6:
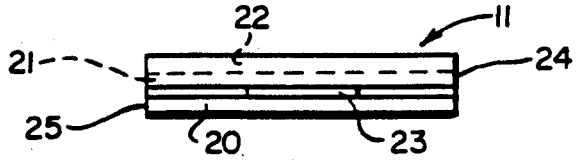
FIG. 6 is a side view of a coupon which is received and delivered by the apparatus.

Referring to FIG. 6, each coupon 11 is composed of three folded panels 20,21,22, two of which (20 and 21) are connected together by a spot of glue 23 to prevent the coupon from unfolding by itself. Each coupon 11 has a leading edge 24 and a trailing edge 25 when the coupon moves in the downstream direction indicated in FIG. 1.

Delivery equipment 14 is shown in detail in FIGS. 2–5. Equipment 14 includes a frame comprising a pair of side plates 28,29 (FIGS. 3–4) between which extend a series of four rotatable rollers 30–33 having respective axes of rotation aligned in a horizontal plane. Also supported between side plates 28,29, and located below rollers 30–33 are an idler roller 34 and a tensioning roller 35 for a continuous belt 36 entrained around all of rollers 30–35.

Belt 36 extends longitudinally around all of roller 30–35, overlies the top of each of rollers 30–33 and overlies each space between any two adjacent rollers in the group of rollers 30–33. Belt 36 is driven, in a clockwise sense as viewed in FIG. 3, by roller 33 which, in turn, is driven by a conventional driving mechanism (not shown). Belt 36 defines a continuous, uninterrupted bridge 37 between rotary cutter 12/anvil 13 and shingling conveyor 16. Bridge 37 has an upstream end 38 adjacent rotary cutter 12/anvil 13 and a downstream end 39 adjacent shingling conveyor 16. Bridge 37 has dimensions in a downstream direction and in a direction transverse to the downstream direction greater than the dimensions of coupon 11 in the same two directions.

Coupons 11 are initially discharged or shot out from the nip 15 between rotary cutter 12 and anvil 13 with the coupon disposed in a straight-line alignment in a downstream direction, undeflected either upwardly, downwardly or sideways. Upstream end 38 of bridge 37 is positioned sufficiently close to rotary cutter 12/anvil 13 to receive a discharged coupon 11 before the coupon has an opportunity to deflect from the aforementioned straight-line alignment in either an upward or downward or sideways direction. As belt 36 rotates in a clockwise sense as viewed in FIG. 3, coupon 11 is carried by the belt in a downstream direction toward shingling conveyor 16. Located above continuous belt 36 is structure, now to be described, which cooperates with belt 36 to perform a number of important function with respect to the alignment and delivery of coupon 11.

Extending between side plates 28,29 is a shaft 42 which supports all of the structure located above belt 36. Mounted on shaft 42 are a pair of frame members 43,44 between which extends a top plate 45.

Members 43,44 and plate 45 define a frame from which extends, in an upstream direction, a composite member 46 carrying a pair of axles 47,48 spaced apart in a downstream direction. Rotatably mounted on upstream axle 47 are a pair of wheels 49,49, and rotatably mounted on downstream axle 48 are a pair of wheels 50,50. Each upstream wheel 49 has a pair of circumferential grooves 51,51, and each downstream wheel 50 has a pair of circumferential grooves 52,52. Each of the grooves 51 in an upstream wheel 49 is aligned with a corresponding groove 52 in a downstream wheel 50.

Figure 3:
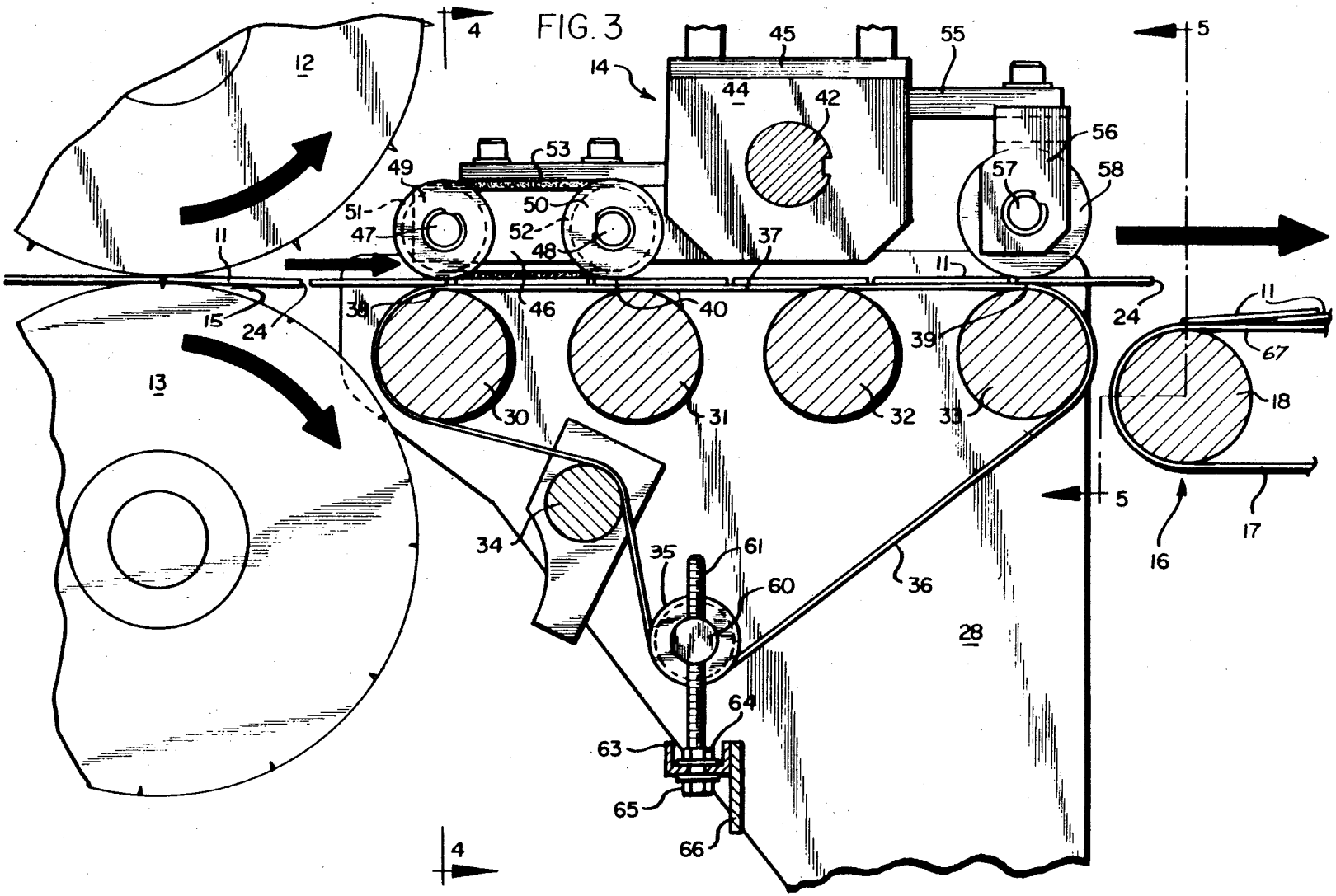
FIG. 3 is a fragmentary, side elevational view, partly in section, of the apparatus.

There are two pairs of aligned wheels 49,50. Each pair carries a stretched O-ring 53 composed of elastic material and extending around both paired wheels 49,50. Portions of the O-ring are received in each of the grooves 51,52 of paired wheels 49,50. O-ring 53 engages the top surface of a coupon 11 as the coupon is carried in a downstream direction by belt 36. The spacing in a downstream direction between (a) the axis of axle 47 and (b) the axis of axle 48 is greater than the dimension in a downstream direction of coupon 11. Accordingly, that part of O-ring 53 which is in a position to engage the top surface of coupon 11 has a dimension, in a downstream direction, greater than the dimension of coupon 11 in that direction. As a result, O-ring 53 can engage the top surface of coupon 11 simultaneously along the entirety of the coupon's dimension in a downstream direction (FIG. 3).

Figure 4:
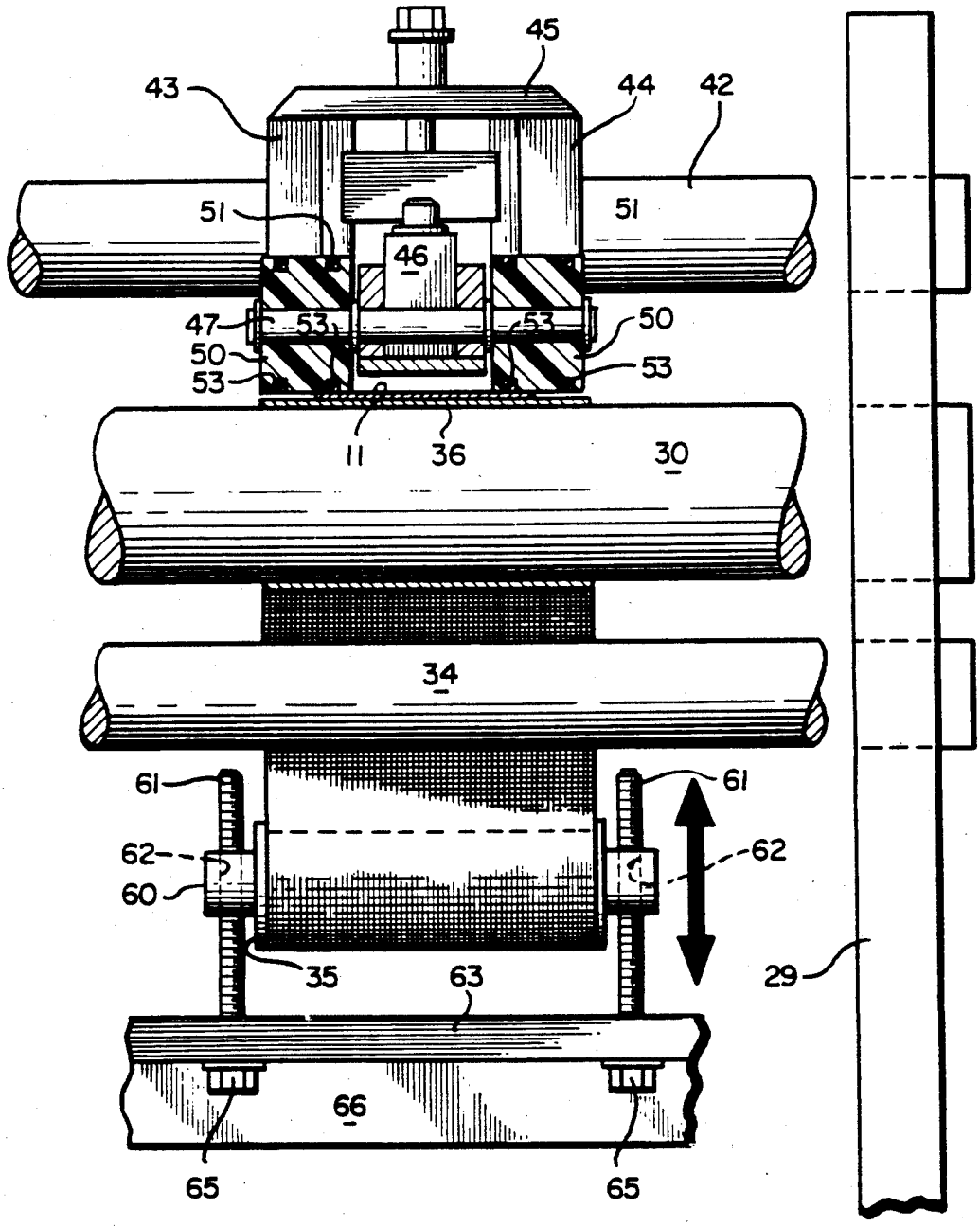
FIG. 4 is a sectional view taken along line 4—4 in FIG. 3.

As shown in FIG. 4, the top surface of coupon 11 is engaged by a pair of O-rings 53,53. Each of these two O-rings is carried by a different pair of wheels 49,50. The two coupon-engaging O-rings 53,53 are spaced apart, along the axis of rotation of the wheels, in a direction transverse to the direction of downstream movement of coupon 11. The net result is that each such O-ring 53 engages the top surface of coupon 11 at a respective one of two locations spaced apart on the coupon in a direction transverse to the downstream direction. In addition, each of the two engagement locations is alongside a respective opposite side edge of the coupon. The engagement between an O-ring 53 and the top surface of coupon 11 is essentially engagement by line contact, as distinguished from area contact which is the type of engagement between the lower surface of coupon 11 and belt 36.

As shown in FIG. 4, belt 36 engages the bottom surface of coupon 11 along a contact area which underlies each of the lines of force exerted against the top surface of the coupon by O-rings 53, 53 and which also underlies the opposed side edges of the coupon. The distance between the outer limits of contact against the coupon's bottom surface, in the aforementioned transverse direction, is greater than the distance between the spaced apart lines of force exerted against the coupon's top surface by O-rings 53, 53.

As shown in FIG. 4, each coupon 11 is engaged by one O-ring 53 carried by each pair of wheels 49,50. There is an additional O-ring 53 carried by each pair of wheels 49,50 and located to the outside of an O-ring 53 which engages the top surface of coupon 11. The outer pair of 0 rings 53,53 would be useful for engaging a coupon which has larger dimensions, in a direction transverse to the downstream direction, than does coupon 11 illustrated in FIG. 4.

The two O-rings 53,53 which engage coupon 11 from above cooperate with belt 36 to maintain the speed of movement of coupon 11, in a downstream direction, the same as the speed of belt 36.

Referring to FIG. 3, each of the two coupon-engaging O-rings engages the downstream edge 24 of a coupon 11 immediately upon receipt of coupon 11 on belt 36, and, in this manner, the O-rings prevent the coupon's downstream edge 24 from deflecting upward, which would be undesirable. Coupon 11 is sandwiched between belt 36 and O-rings 53,53, as the coupon moves in a downstream direction from the upstream end 38 of bridge 37. This sandwiching engagement maintains coupon 11 in the straight-line alignment, in a downstream direction, in which the coupon is discharged from rotary cutter 12/anvil 13 and in which the coupon is initially received on belt 36.

O-rings 53,53 are urged downwardly by the weight of the structure 44–50 which carries the O-rings, and that weight should normally b sufficient to provide the desired amount of downward pressure for the O-rings to exert upon the coupon. The movement in a downstream direction of driven belt 36 is transmitted through sandwiched coupon 11 to O-rings 53,53 to drive the O-rings in a counter-clockwise sense as viewed in FIG. 3. This is effectuated by the line contact between the O-rings and the coupon. Line contact concentrates the downward force exerted by the weight of the structure which carries the O-rings, thereby increasing the pressure at the contact locations between O-rings 53,53 and coupon 11, compared to the pressure which would exist if the contact were area contact (as with a belt) rather than line contact.

O-rings 53,53 engage the top surface of coupon 11 continuously between upstream end 38 of bridge 37 and an intermediate position 40 between the bridge's upstream end 38 and its downstream end 39 (FIG. 3). Additional structure is provided for engaging the top surface of coupon 11 as it moves downstream between intermediate position 40 and the bridge's downstream end 39, and this structure will now be described, with reference to FIGS. 2–3 and 5.

Figure 5:
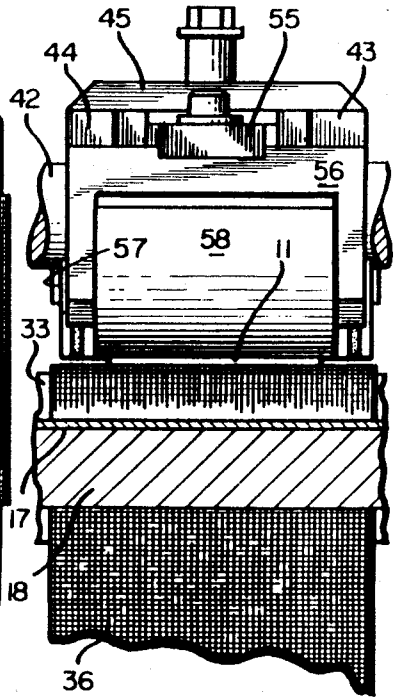
FIG. 5 is a sectional view taken along line 5—5 in FIG. 3.

Extending in a downstream direction from the frame defined by elements 43–45 is a member 55 from which depends a clevis 56 which carries an axle 57 on which is rotatably mounted a delivery control wheel 58 which engages the top surface of coupon 11 as the coupon leaves belt 36 at downstream bridge end 39 for transfer to shingling conveyor 16. Wheel 58 is aligned in a downstream direction with the two pairs of grooved wheels 49,50. As shown in FIG. 5, wheel 58 has a dimension in an axial direction thereof greater than the transverse dimension of coupon 11. As a result, wheel 58 engages the top surface of coupon 11 across the totality of the coupon's dimension in a direction transverse to the downstream direction.

Wheel 58 is located at downstream bridge end 39, above belt 36, and engages coupon 11 from above as the coupon passes over the downstream bridge end. Wheel 58 has a size and location such that wheel 58 and belt 36 cooperate to engage therebetween at least the upstream end portion of coupon 11 until the coupon's downstream edge 24 rests on conveyor 16. Wheel 58 maintains the coupon in the straight-line alignment in which the coupon was received at upstream end 38 of bridge 37 and in which the coupon was maintained by O-rings 53,53 and belt 36. This straight-line alignment is maintained as the coupon undergoes transference from belt 36 to conveyor 16. In addition, wheel 58 and belt 36 cooperate to restrain coupon 11 from shooting off belt 36 at downstream bridge end 39 toward conveyor 16. Shooting off of a coupon 11 is undesirable because it is difficult to arrange a shot-off coupon in the desired shingled relation on conveyor 16.

There is a portion of bridge 37, between intermediate bridge position 40 and downstream bridge end 39, where coupon 11 is not engaged from above by either O-rings 53,53 or wheel 58, as the coupon is carried downstream by belt 36. However, there will be no deflection of coupon 11 along that portion of the bridge because coupon 11 passes intermediate bridge position 40 with a momentum sufficient to maintain the straight-line alignment in which the coupon was maintained upstream of bridge position 40. In addition, the speed with which coupon 11 moves between disengagement with O-rings 53,53 at intermediate bridge position 40 and engagement with roller 58 at downstream bridge end 39 is so fast that the time in which a coupon is totally disengaged between O-rings 53,53 and wheel 58, is insufficient for any deflection to occur.

As noted above, belt 36 extends around a tensioning roller 35. The tension on belt 36 can be adjusted employing expedients now to be described, with reference to FIGS. 3–4.

Tensioning roller 35 is rotatably mounted on an axle 60 having a pair of opposite ends at each of which is formed a transverse threaded opening 62 for threadedly engaging a respective threaded member 61 extending vertically upwardly from a channel member 63 in turn supported by a bar 66 extending between side plates 28,29. A nut 64 (FIG. 3) cooperates with a head 65 on threaded member 61 to hold the threaded member against rotation, when the nut has been tightened. The tension in belt 36 can be increased or decreased by rotating threaded member 62 in one sense or another, after loosening nut 64.

Referring again to FIGS. 1 and 3, a coupon received and delivered by equipment 14 does not undergo deflection either vertically or sideways at any time from the time it leaves rotary cutter 12/anvil 13 until the time the coupon is received on shingling conveyor 16. Coupons received on conveyor 16, after having been processed by equipment 14 are arranged in straight, aligned, shingled relation and are conveyed further downstream by conveyor 16 in that arrangement. Located downstream of conveyor 16 is an additional conveyor 68 (FIG. 1), operated at a speed slower than conveyor 16, and located slightly below conveyor 16, to increase the compactness of the shingling arrangement. If desired, more conveyors, each running at a slower speed and each located slightly below the conveyor upstream thereof, may be provided.

As a row of shingled coupons 11 proceeds along the most downstream conveyor, a group thereof can be readily picked off the conveyor by a worker and arranged in a row on a tray packed in a container for shipment to a user. This is the only handling to which the coupons are subjected before they are received by the user. Cleanliness is maximized, and theft problems are minimized because no coupons are left lying around between various stages of processing.

Apparatus constructed in accordance with the present invention can produce, in a 24-hour period, on a single line, 15 million pieces of printed product. This is in comparison to a production rate of 500,000–600,000 pieces of the same size in the same time period employing the batch procedure described above under the heading "Background Of The Invention".

In a typical manufacturing operation employing the apparatus of the present invention to produce a coupon 11 of the type illustrated in FIG. 6, the coupon can have the following dimensions upon discharge from rotary cutter 12/anvil 13: 2-3/16 in. (5.6 cm) in a downstream dimension (i.e., between the coupon's leading edge 24 and its trailing edge 25), and 2 in. (5.1 cm) transverse to the downstream dimension. For a coupon of that size, the distance from nip 15 of rotary cutter 12/anvil 13 to upstream end 38 of bridge 37 can be about $3\frac{7}{8}$ in. (9.8 cm); the length of engagement, in a downstream direction, between an O-ring 53 and coupon 11 (i.e., the distance from upstream bridge end 38 to intermediate position 40 on bridge 37) can be about $2\frac{3}{8}$ in. (6 cm); the distance on bridge 37 between intermediate position 40 and downstream bridge end 39 (where coupon 11 is engaged by delivery control wheel 58) can be about $5\frac{1}{8}$ in. (13 cm); and the vertical drop from downstream bridge end 39 to the flat part 67 on shingling conveyor 16 can be about $\frac{7}{8}$ in. (2.2 cm). A similar vertical drop can be provided between shingling conveyor 16 and additional conveyor 68.

In one embodiment of the present invention, the delivery equipment illustrated at 14 in FIGS. 1–5 can be converted to handle larger printed products. In such a conversion, belt 36 is removed, and all of rollers 30–33 are driven with a conventional driving train connected to the same driving mechanism as drives roller 33 in the embodiment for handling small-sized coupons 11. In addition, grooved wheels 49,50 and O-rings 53,53 are removed and replaced by ungrooved idler wheels, and wide, downstream delivery control wheel 58 is removed and replaced by a narrower wheel. In this arrangement, the axis of each idler wheel would be located directly above the axis of a respective roller 30–31, and the axis of the downstream wheel would be located directly above the axis of roller 33. In addition, the spacing between any two adjacent rollers in the group 30–33 would have to be substantially less than the dimension, in a downstream direction, of the printed product to be handled by the converted equipment. Moreover, in the converted arrangement, the entire assembly supported between side plates 28,29 would be moved about ½ in. (1.27 cm) further downstream from rotary cutter 12/anvil 13 than was equipment 14.

The foregoing detailed description has been given for clearness of understanding only, and no unnecessary limitations should be understood therefrom, as modifications will be obvious to those skilled in the art.

I claim:

1. A method for manufacturing small-sized, printed paper coupons for food packages, wherein each coupon has an upstream edge, a downstream edge and opposite side edges, said method comprising the steps of:

separating a continuous ribbon of said coupons into individual pieces;

discharging each individual piece initially in a straight-line alignment facing in a downstream direction toward a conveyor separated by a space from the location of said separating step;

carrying each of said coupons in a downstream direction across said space toward said conveyor;

during said carrying step, exerting, against the top surface of said moving coupon, a downward force concentrated along a pair of lines, each extending longitudinally in said downstream direction, said pair of lines being spaced apart in a direction transverse to said downstream direction;

and, during said carrying step, engaging the bottom surface of said moving coupon along a contact area underlying each of said lines of force exerted against the top surface of said coupon and also underlying each of said opposite side edges of the coupon, with the distance between the outer limits of contact against the bottom surface, in said transverse direction, being greater than the distance between said spaced apart pair of lines.

2. A method as recited in claim 1 wherein:

each of said lines of force is located adjacent a respective opposite side edge of said coupon.

3. A method as recited in claim 1 wherein:

said downward force is exerted against the top surface of said coupon simultaneously along the entirety of its dimension, between the coupon's upstream edge and its downstream edge, at both of said transversely spaced lines.

4. A method as recited in claim 1 and comprising:

engaging the bottom surface of said coupon immediately following said discharging step and before said coupon has an opportunity to deflect from said straight-line alignment;

and engaging the top surface of said coupon at its downstream edge immediately following said discharging step to prevent the downstream edge from deflecting upward.

5. A method as recited in claim 1 and comprising:

transferring said moving coupons to said conveyor;

maintaining said coupon in said straight-line alignment during said transferring step;

and restraining said coupon from being shot toward said conveyor.

6. A method as recited in claim 5 and comprising:

engaging the top surface of said coupon, across the totality of its dimension in said transverse direction, during said transferring step.

7. A method as recited in claim 5 and comprising:

engaging both the top surface and the bottom surface on at least a part of said coupon during said transferring step, until the downstream edge of said coupon rests on said conveyor.

8. In an apparatus for manufacturing printed paper coupons, wherein said apparatus comprises a rotary cutter for separating a continuous ribbon of said coupons into individual pieces, each having an upstream edge and a downstream edge and opposite side edges, and for discharging each individual piece initially in a straight-line alignment in a downstream direction, and a conveyor located downstream of said rotary cutter, the improvement which permits the use of said apparatus in the manufacture of small-sized coupons for food packages, said improvement comprising:

continuous belt means defining a continuous, uninterrupted bridge located between said rotary cutter and said conveyor;

said bridge having an upstream end facing toward said rotary cutter and a downstream end facing toward said conveyor;

said upstream end comprising means for receiving a small-sized coupon coming from the rotary cutter;

means for driving said belt means to carry said coupon in a downstream direction toward said conveyor;

and a first coupon-engaging means, located above said belt means, and cooperating with said belt means to maintain the speed of movement of said small-sized coupon, in a downstream direction, the same as the speed of the belt means;

said first coupon-engaging means comprising means for exerting, against the top surface of said coupon, a downward force concentrated along a pair of lines, each extending longitudinally in said downstream direction, said pair of lines being spaced apart in a direction transverse to said downstream direction;

said belt means comprising means for engaging the bottom surface of said coupon along a contact area underlying each of said lines of force exerted against the top surface of said coupon and also underlying each of said opposite side edges of the coupon, the distance between the outer limits of contact against the bottom surface, in said transverse direction, being greater than the distance between said spaced apart pair of lines.

9. In an apparatus as recited in claim 8 wherein said small-sized coupon has a pair of opposite side edges extending in the downstream direction of said apparatus when the coupon is in said straight-line alignment and wherein:

each of said two lines is alongside a respective opposite side edge of said coupon.

10. In an apparatus as recited in claim 8 wherein said means for exerting a downward force comprises:

means for engaging the top surface of a coupon simultaneously along the entirety of its dimension between its upstream edge and its downstream edge, at both of said transversely spaced lines.

11. In an apparatus as recited in claim 8 wherein said means for exerting a downward force comprises:

a pair of means each for engaging said coupon along a respective one of said transversely spaced lines;

each of said pair of engaging means comprising means for engaging the top surface of a coupon simultaneously along the entirety of its dimension between its upstream edge and its downstream edge.

12. In an apparatus as recited in claim 11 wherein each of said pair of engaging means comprises:

a pair of rotatable wheels spaced apart in a downstream direction;

a circumferential groove on each of said wheels;

and a stretched O-ring composed of elastic material extending around both of said wheels and having portions thereof received in each of said wheel grooves.

13. In an apparatus as recited in claim 12 wherein:

said pair of wheels is spaced apart a distance exceeding the dimension of said small-sized coupon in a downstream direction.

14. In an apparatus as recited in claim 12 wherein each stretched O-ring comprises part of said means for exerting a downward force concentrated along a line.

15. In an apparatus as recited in claim 8 wherein:

said belt means comprises means for moving said coupon from the upstream end of the bridge to the downstream end thereof;

and said means for exerting a downward force comprises means for engaging the top surface of said coupon continuously between the upstream and downstream ends of the bridge.

16. In an apparatus as recited in claim 8 wherein:

said apparatus comprises a series of spaced-apart, rotating rollers located between said rotary cutter and said conveyor;

said belt means extends longitudinally around said rollers, overlies the top of each of said rollers and overlies each space between said rollers;

and said driving means for the belt means comprises one of said rollers.

17. In an apparatus as recited in claim 8 wherein:

the bridge defined by said belt means has dimensions in (a) a downstream direction and (b) in a direction transverse to said downstream direction greater than the dimensions of said small-sized coupon in the same directions;

18. In an apparatus as recited in claim 8 wherein:

said upstream end of the bridge is positioned sufficiently close to said rotary cutter to receive a small-sized coupon discharged from the rotary cutter, before said coupon has an opportunity to deflect from said straight-line alignment;

and said first coupon engaging means comprises means for engaging the downstream edge of said coupon immediately upon receipt of the coupon on said belt means to prevent said downstream edge from deflecting upward.

19. In an apparatus as recited in claim 8 wherein:

said belt means comprises means for transferring said coupon to said conveyor;

said apparatus comprising a second coupon-engaging means, located above said belt means downstream of said first coupon-engaging means, and for maintaining said coupon in said straight-line alignment as the coupon undergoes transference from the belt means to the conveyor;

said second coupon-engaging means and said belt means comprising means cooperating to restrain said small-sized coupon from shooting off said downstream end toward the conveyor;

said conveyor comprising means for conveying a series of said small-sized coupons downstream, in straight, aligned, shingled relation, when said small-sized coupons are transferred onto the conveyor in said straight-line alignment.

20. In an apparatus as recited in claim 19 wherein:

said second coupon-engaging means comprises means for engaging the top surface of said coupon across the totality of its dimension in a direction transverse to said downstream direction.

21. In an apparatus as recited in claim 20 wherein:

said second coupon-engaging means comprises rotatable wheel means having a dimension in an axial direction greater than the transverse dimension of said small-sized coupon.

22. In an apparatus as recited in claim 19 wherein:

said second coupon-engaging means and said belt means cooperate to engage at least a part of said small-sized coupon therebetween, at the downstream end of the bridge, until the downstream edge of the coupon rests on the conveyor.

23. In an apparatus as recited in claim 19 wherein:

said belt means comprises means for moving said coupon from the upstream end of the bridge to the downstream end thereof;

said means for exerting a downward force comprises means for engaging the top surface of said coupon continuously between the upstream end of said bridge and an intermediate position between the upstream and downstream ends of the bridge;

and said second coupon-engaging means comprises means for engaging the top surface of said coupon as it moves downstream between said intermediate position and the downstream end of the bridge.

* * * * *